US005339958A

United States Patent [19]

Taravella et al.

[11] Patent Number: 5,339,958

[45] Date of Patent: Aug. 23, 1994

[54] TWO-PIECE DUNNAGE DEVICE FOR DUNNAGE SEPARATION

[75] Inventors: Philip Taravella, Grosse Pointe Shores; Ronald S. Domanski, St. Clair Shores, both of Mich.

[73] Assignee: Anchor Bay Packaging Corporation, St. Clair Shores, Mich.

[21] Appl. No.: 180,736

[22] Filed: Jan. 13, 1994

[51] Int. Cl.[5] ..... B65D 81/02; B65D 85/30

[52] U.S. Cl. ..... 206/521; 206/523; 206/593

[58] Field of Search ..... 206/521, 523, 593

[56] References Cited

U.S. PATENT DOCUMENTS 2,005,967 6/1935 Berdan .
2,281,657 5/1942 Aquino .
3,356,209 12/1967 Pezely, Jr. .
4,840,277 6/1989 Waldner ..... 206/523
5,178,279 1/1993 Carroll ..... 206/521
5,249,678 10/1993 Traina ..... 206/521 X

*Primary Examiner*—William I. Price
*Attorney, Agent, or Firm*—Dykema Gossett

[57] ABSTRACT

A two-piece dunnage device includes a cushioning piece made of a resilient foamed plastic material and a supporting piece to which the cushioning piece is mechanically attached without adhesives or bonding agents. The cushioning piece has a plurality of cushioning elements that extend from a connecting web. The cushioning elements are spaced apart to provide support for articles shipped in a container. The supporting piece presents the cushioning piece away from the sides of the shipping container. The supporting piece may be made of plastic or fiberboard and may be shaped as beams either folded into a cross-section or extruded into a cross-section. Such cross-sections include circles, triangles and rectangles.

8 Claims, 4 Drawing Sheets

TWO-PIECE DUNNAGE DEVICE FOR DUNNAGE SEPARATION

BACKGROUND OF THE INVENTION

I. Field of the Invention

This invention relates to packaging for shipping containers and more particularly to dunnage used in packing shipping containers which dunnage is likely to be thrown into the environment once it is no longer used for packing.

II. Discussion of line

The packing and shipping of articles, particularly fragile articles, has always presented certain difficulties, including the danger of breaking, scrapping, chipping or otherwise damaging the articles. Accordingly, materials are used to support and cushion articles being shipped in order to prevent damage. For example, U.S. Pat. No. 2,281,657 discloses a package that protects flat articles against abrasion by firmly holding the articles in the package so that no rubbing takes place. As another example, U.S. Pat. No. 2,005,967 discloses a package In which an article is immobilized by use of corrugated cardboard and filler material. In yet another example, U.S. Pat. No. 3,356,209 discloses foam plastic to immobilize and cushion the article.

Such packaging with use of fillers has been successful in preventing breakage, but not without a cost in other ways. Often when shipped articles are unpacked and the packaging is discarded, and the fillers are thrown out into the environment, producing costs in cleaning up the environment, producing landfills, and operating incinerator systems with complex filtration methods for reducing effluent emissions.

There are those skilled in the art who have become particularly aware of environmental concerns, and have reduced the assaults on the environment by recycling dunnage. But recycling causes other problems. One problem is that composite dunnage, such as foam products attached to corrugated fiberboard sheets or plastic products of different chemical makeup, requires that the constituent parts that are not chemically the same to be separated for different recycling treatments. Inasmuch as composite products are usually attached together by use of adhesives or stapling items, such constituent parts are hard to separate as chemically different parts. Accordingly, often composite items that are not separable from other recyclable items are destroyed by methods having the environmental consequences sought to be avoided.

III. Prior Art

Conventionally, two-piece composite dunnage is structured as the example of the prior art shown in FIG. 1 of the drawings. A composite dunnage section 100 comprises a foam or cushioning product 110 attached to a corrugated product 112. The foam product 110 is attached to the corrugated product 112 by an adhesive 114 applied to the foam product 110, the corrugated product 112, or both.

A device for separating articles packed in a container, improved from the standpoint of being kinder to the environment, was developed by the inventors. The device is composite dunnage 200 comprising a foam or cushioning piece 210 mechanically attached to a plastic corrugated sheet 212. The cushioning piece 210 includes a plurality foam cushioning sections 214 joined by and projecting from an integral foam web 216. The foam cushioning sections 214 project from the foam web 216 into a cross-section of a varying width. The plastic corrugated sheet 212 to which the foam piece 210 is Joined has a plurality of openings 218 therein, each of a width adapted to accept a foam cushioning section 214 when the foam cushioning section 214 is compressed to be forced through the opening 218 in the plastic corrugated sheet 212. Once forced through and allowed to decompress, at least one cross-sectional portion of each of the foam cushioning sections 214 decompresses to a width that is greater than the width of the corresponding opening 218 in the plastic corrugated sheet 212, thus impeding the foam cushioning section 214 of the foam piece 210 from passing back through the corresponding opening 218. The common Joining foam web 216 remains on a side of the plastic corrugated sheet 212 opposite the side trapping the decompressed foam cushioning sections 214, so that the plastic corrugated sheet 212 is trapped between the foam web 216 and the greater width portions of the foam cushioning sections 214. This mechanical attachment allows the composite dunnage 200 to be reused. When the composite dunnage 200 is no longer needed, each foam cushioning section 214 may again be compressed to be pushed through each opening 218, thereby separating the foam piece 210 from the plastic corrugated sheet 212 without any adhesive residue.

While the foregoing product provides for a solution in separating different parts of the dunnage, the product is not particularly adapted for the packing of large articles in a shipping container. One shortcoming of our earlier invention is that the disposition of the web on the opposite side of the sheet from the foam cushioning sections is wasteful in most applications, particularly where the shock absorbing characteristics of the foam piece is more advantageous when fully used in contact with an article shipped. Another shortcoming is that tapes, adhesives and staples are often necessary to position the product at an elevation at which a shipped article might come into contact with a side of a shipping container.

SUMMARY OF THE INVENTION

I. Objects of the Invention

Accordingly, it is one object of the present invention to utilize a mechanical method of attaching parts of a composite dunnage, so that the parts may be separated into unadulterated parts for recycling purposes.

It is another object of the present invention to provide composite dunnage particularly adapted for protecting articles to be shipped in a shipping container, wherein the composite dunnage has mechanically attached and separable components.

A still further object of the present invention is to provide improved composite dunnage adapted to fit into a shipping container at certain elevations from the floor of the shipping container to provide for immobilization and cushioning of articles being shipped therein.

II. Disclosure of the Invention

These objects are accomplished by the present invention in which a first embodiment of a two-piece dunnage device includes a cushioning product or piece and a supporting piece. The cushioning piece is preferably made of a cellular or a foamed plastic. The supporting piece is corrugated fiberboard, a plastic corrugated sheet or a solid plastic sheet. It may also be made from wood, metal or other suitable material.

The cushioning piece comprises a plurality of projecting cushioning elements extending from a web wall connecting the cushioning elements. At the free end of each cushioning element is a flat face. These projections or cushioning elements protect an article therein by limiting its movement and by spacing the article from adjacent articles being transported in a shipping container.

On a side of the web wall opposite the side from which the cushioning elements project are keys or locking tabs spaced at determinant distances from one another. Each key or tab has a side that has a width, which projects along the longitudinal projection of the web wall and which is greater at a distance away from the web wall than the width most proximate to the web wall. Preferably the width expands as the key projects away from the web wall in a manner to provide a curved profile for the key.

The supporting piece has a plurality of openings that are spaced from one another in accordance with the spacing of the keys from one another. The keys or locking tabs may be inserted into openings and held therein. The keys, being made of a resilient, compressible material, may be forced through the openings and resiliently expanded to hold the keys within the openings. Accordingly, the foam piece may be joined to the supporting piece and mechanically held and removably attached thereto.

The supporting piece is foldably formed as a triangular beam, with an apex projecting away from the cushioning piece and held into that shape by the locking tabs or keys inserted into openings provided in the supporting piece or beam. End flaps on the triangular beam are used to support the supporting piece or beam on the shipping container walls.

Other embodiments of the invention may be also placed within the shipping carton or container. For example, a two-piece dunnage device may be set in position on the floor of the container. In another example a box beam supporting piece depends from one wall of the shipping container. In yet another example, a triangular support piece is positioned on the floor of the container and is spaced a determinate distance from the side wall of the container.

The support pieces of the dunnage may be made of a variety of shapes and material structures.

BRIEF DESCRIPTION OF THE DRAWINGS

Other objects and features of the invention will become apparent by reference to the following specification and to the drawings, in which.

DETAILED DESCRIPTION OF INVENTION

Figure 1:
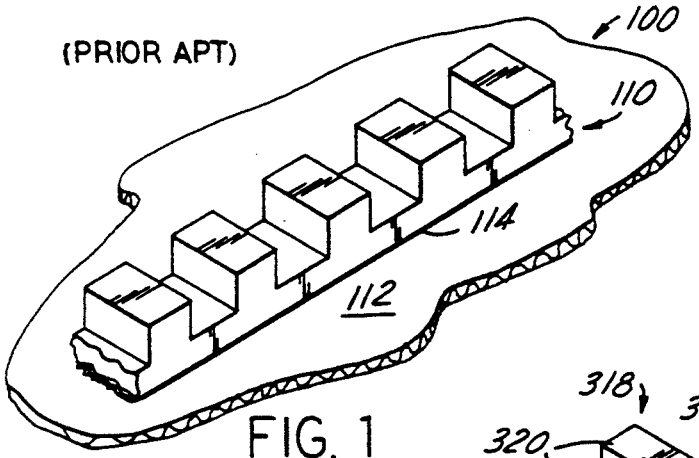
FIG. 1 is illustrative of a two-piece dunnage of the prior art.
Figure 2:
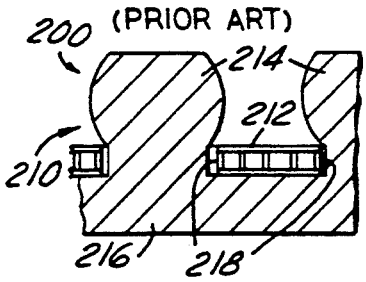
FIG. 2 is a general detail of a cross-section of another two-piece dunnage of the prior art.
Figure 3:
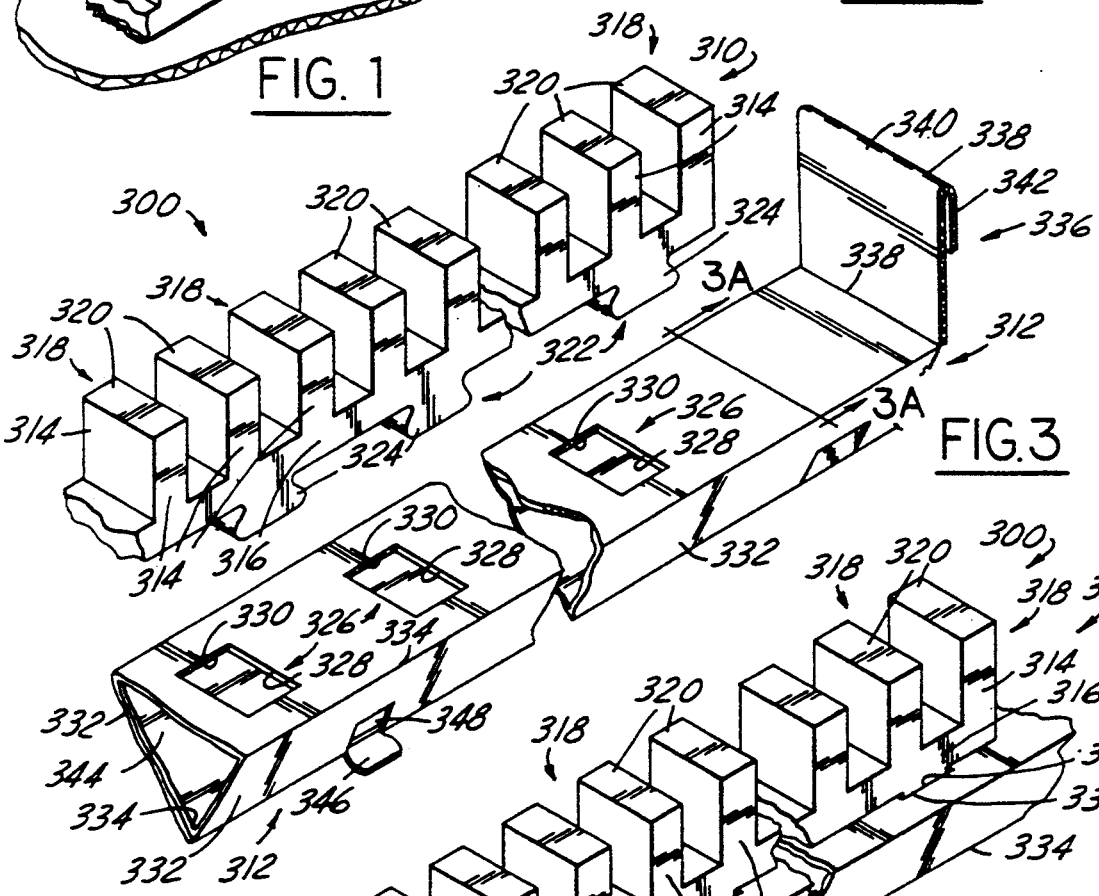
FIG. 3 is a partial perspective view of an embodiment of the present invention showing composite dunnage parts which are separated.
Figure 4:
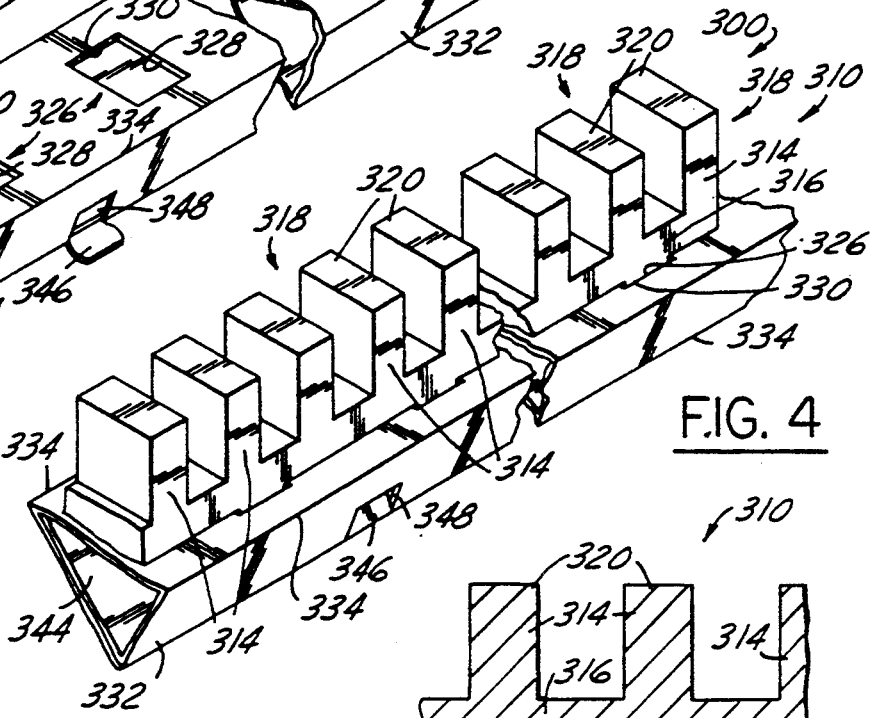
FIG. 4 is a partial perspective view of an embodiment of the present invention showing composite pieces mechanically attached.
Figure 3A:
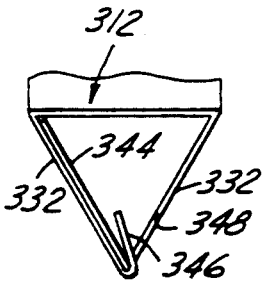
FIG. 3A is a cross-sectional view of the embodiment shown in FIG. 3 taken generally along line 3A—3A of FIG. 3.

Referring now to the drawings, and particularly to FIGS. 3, 3A and 4, there is shown one embodiment of a two-piece dunnage or device 300 which includes a cushioning piece 310 and a supporting piece 312. Preferably, the cushioning piece 310 is preferably made of a cellular or foamed plastic such as a polyether polyurethane foam or a polyethylene foam, but other open and closed cell foams may be used, for example polyester polyurethane foam, cross linked polyethylene foam, reticulated foam, polyvinyl chloride foam, and synthetic rubber products such as Neoprene, EPDN, SBR, and blends of this type. The supporting piece 312 is preferably corrugated fiberboard. Other materials, such as plastic corrugated sheets, plastic foamed sheets or plastic sheets may be used.

The cushioning piece 310 comprises a plurality of projecting cushioning elements 314. The cushioning piece 310 also has a web wall 316 connecting the cushioning elements 314. The cushioning elements 314 accordingly project from the web wall 316. At the free end 318 of each cushioning element 314 is a flat face 320. The projections or cushioning elements 314 secure an article to be transported in a container by limiting its movement. Cushioning elements 314 act as spacing elements to provide for securing articles being transported between adjacent cushioning elements 314.

On a side of web wall 316 opposite the side from which cushioning elements 314 project, are keys or tabs 322 spaced at determinant distances from one another. Preferably, but not a limitation of the present invention, keys 322 are spaced at a greater distance from one another than cushioning elements 314. In the preferred embodiment, each key 322 has a side 324 that has a width projecting along the longitudinal projection of web wall 316. The width of each side 324 is greater at a distance away from web wall 316 than the width most proximate to the web wall 316. Preferably the width expands as key 322 projects away from the web wall 316 in a manner to provide a curved profile for the key or locking tab 322.

Figure 5:
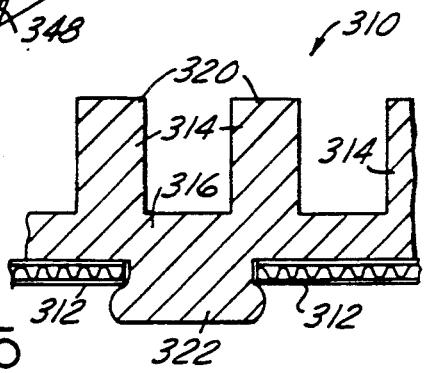
FIG. 5 is a detailed cross-sectional view of the embodiment shown in FIG. 4 taken generally along line 5—5 of FIG. 4.

The supporting piece 312 has a plurality of openings 326 defined by a cross edge 328 and a longitudinal edge 330. The openings 326 are spaced from one another in accordance with the spacing of keys 322 from one another. Each longitudinal edge 330 corresponds to a side 324 of a key 322. Preferably, the width of longitudinal edge 330 is at least greater than the width of side 324 most proximate to the web wall 316 but less than the width of side 324 further away from the web wall 316. The cross edge 328 is at least as 10118 as the cross length or thickness of key 322, that is the dimension of key 322 orthogonal to the side 324. Accordingly, as can be seen in FIG. 4, keys 322 may be inserted into openings 326 and held therein. Keys 322, being made of a resilient, compressible material may be forced through the openings 326 and resiliently expanded to hold keys or tabs 322 within openings 326. Accordingly, cushioning piece 310 may be joined to the supporting piece 312 and mechanically held in attachment thereto, as may be seen in FIG. 5.

In the preferred embodiment of the supporting piece 312 shown in FIGS. 3 and 4, the supporting piece 312 is foldably formed as a triangular beam, with an apex projecting away from the cushioning piece 310. The supporting piece 312 is constructed from a corrugated sheet that has two flaps 332 defined by scored fold lines 334 positioned to foldably allow the formation of flaps 332, which when folded are triangular beam angle walls (one wall has a cross-section of two flaps of which one flap 332 is doubled upon by another flap 344 as will be later explained). The corrugated fiberboard sheet is cut to facilitate end flaps 336. End flaps 336 has fold lines 338 which allow each end flap 336 to be folded to provide an inboard flap 340 and an outboard flap 342. As will be described in reference to FIGS. 6–8, this structure of end flaps 336 facilitates mechanically attaching supporting piece 312 to a shipping carton.

The triangular beam structure is fixed by means of a mechanical locking device as shown in FIG. 3A. One of the flaps 332 has an additional flap 344 extending therefrom. Flap 344 tucks under another flap 332. The other flap 332 has lock tabs 346 extending therefrom. Lock tab 346 has locking edges extending to either side thereof. As flap 344 is tucked under flap 332, lock tabs 346 are returned into tab openings 348. Locking edges 346 are tucked through opening 346 to lock tab 346 thereinto. Accordingly, the beam structure is held in its formation with a triangular cross-section as shown in FIG. 3A.

Figure 6:
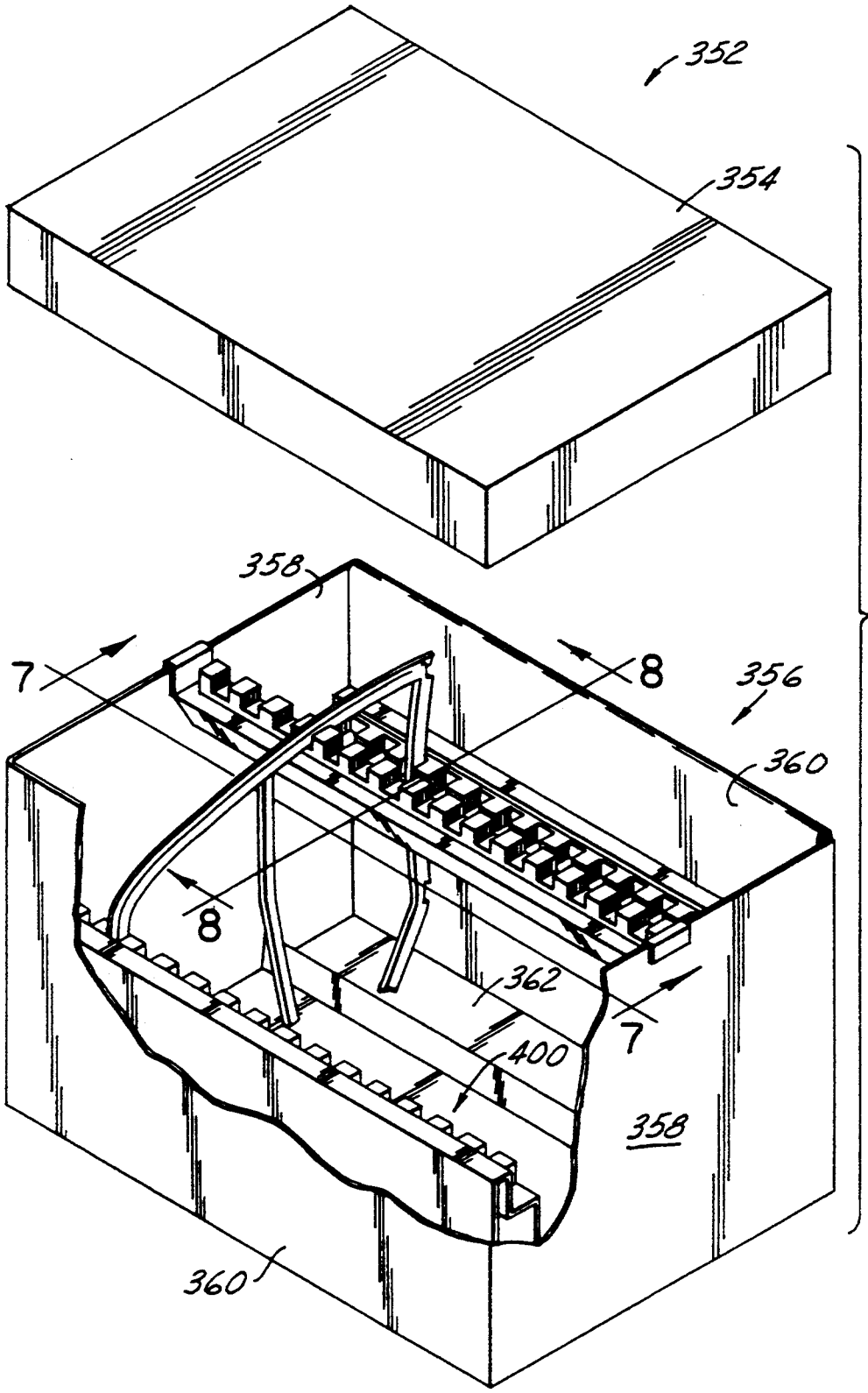
FIG. 6 is a perspective view of two embodiments of the present invention located in a shipping carton.
Figure 7:
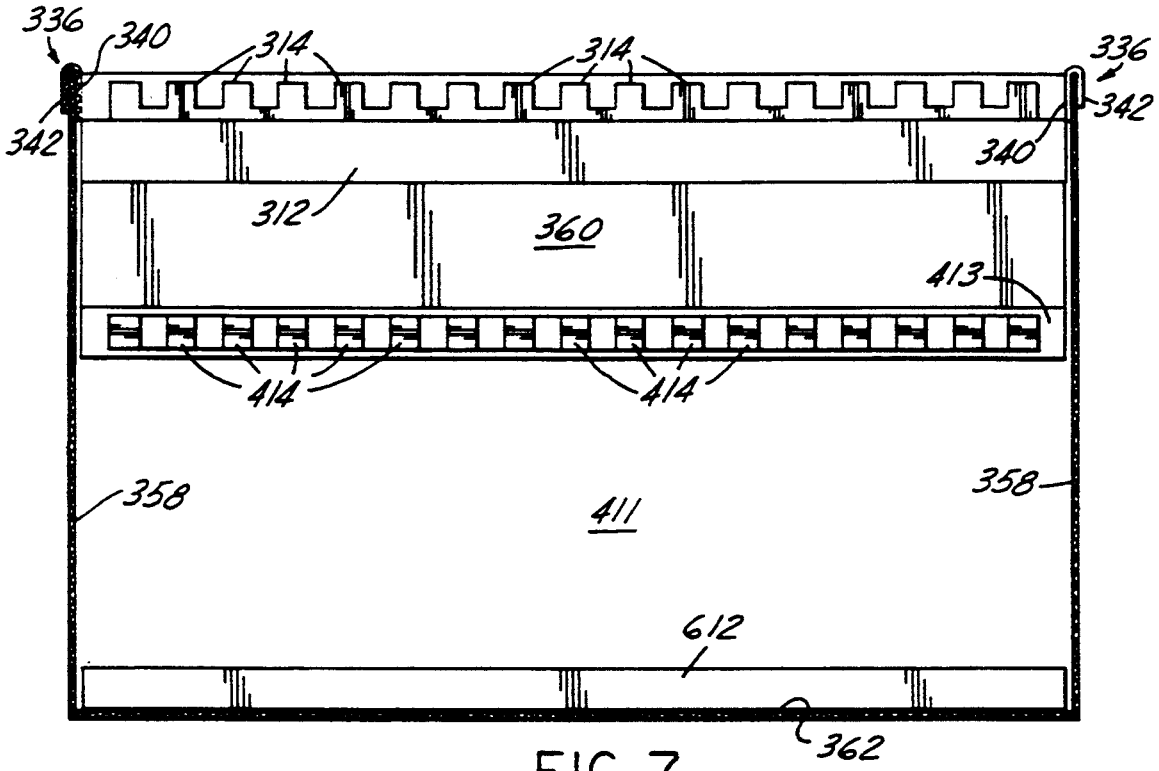
FIG. 7 is a cross-sectional view of the shipping carton taken generally along the line 7—7 of 716.6.
Figure 8:
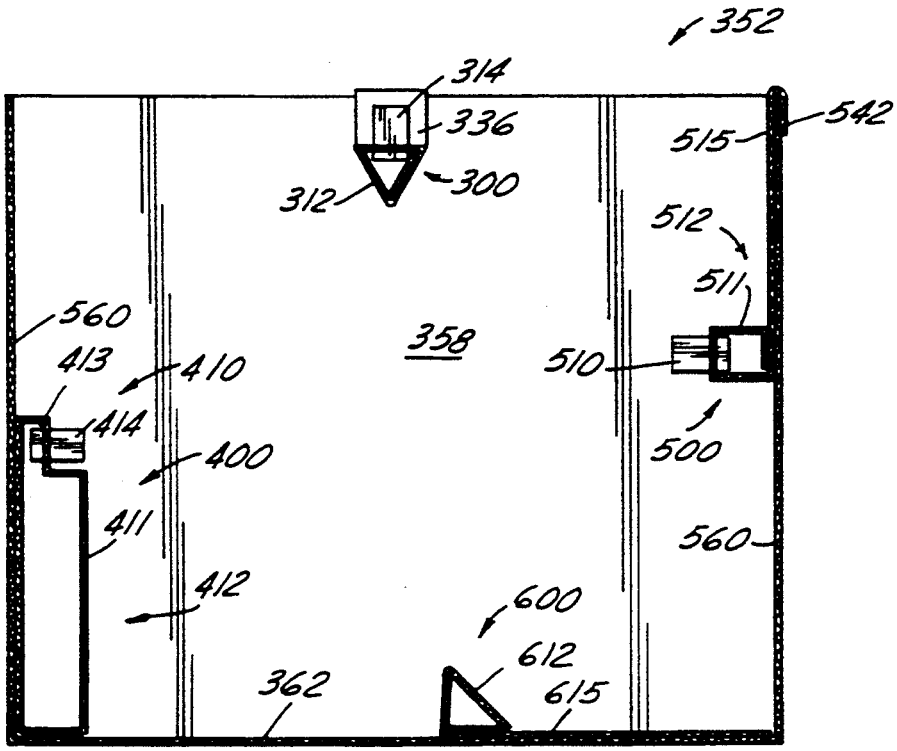
FIG. 8 is a cross-sectional view of the shipping carton taken generally along the line 8—8 of FIG. 6.
Figure 9:
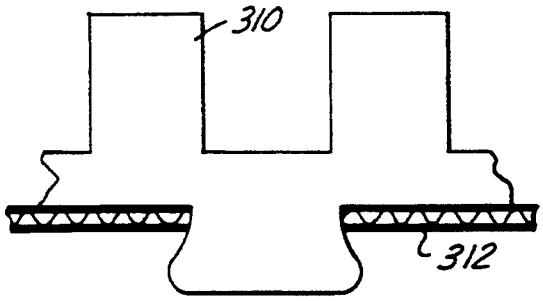
FIGS. 9–14 show various two-piece dunnage or part combinations mechanically held together in accordance with the present invention.
Figure 10:
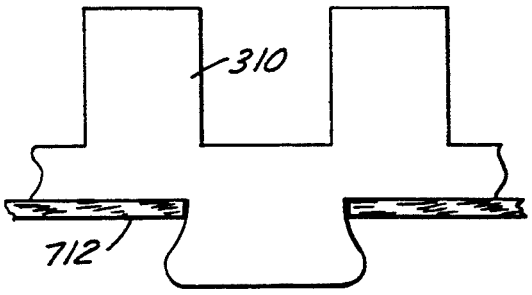
Figure 11:
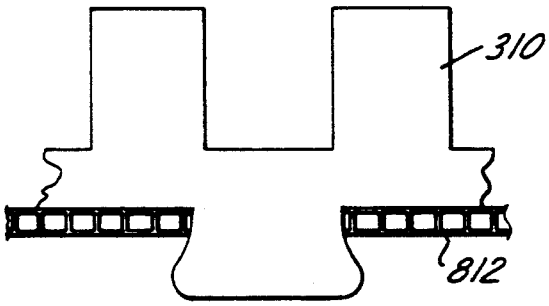
Figure 12:
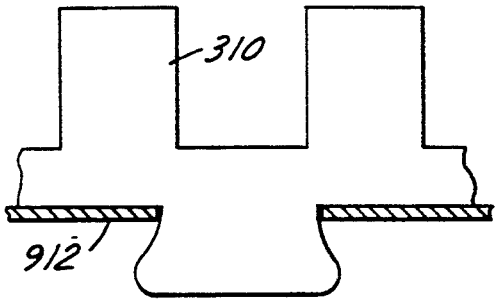

With particular reference now to FIGS. 6–8, a shipping container 352 includes a container cap or top 354 and a container box 356. The container box 356 comprises end wall 358, side walls 360, and container floor 362. In accordance with what is already known by those of ordinary skill in the art, cover 354 is placed on the box 356 and sealed by tape or binders to close the container 352 for shipping. The supporting piece 312 of the first embodiment just described may be positioned on the container 352. In this example, the end walls 358 support the triangular beam structure of the supporting piece 312. If necessary, end flaps 336 may be held in position by temporarily taping outboard flaps 342 to end walls 358.

Other embodiments of the invention may be also placed within the shipping container 352. For example, a two-piece dunnage device 410 may be set in position on the floor 362 of the container 352. Two-piece dunnage device 400 is another embodiment that includes a cushioning piece 410 with cushioning elements 414 and a supporting piece 412. Support piece 412 is structured, as can be seen in FIG. 8, as a box beam 411 having an extension 413. One of ordinary skill in the art will appreciate that the cushioning piece 410 is mechanically attached to the extension 413 of the supporting piece 412 by the structures explained in connection with the first embodiment of the two-piece dunnage described in connection with FIGS. 3–5. It is also to be appreciated that the box beam 411 and extension 413 are formed by scoring a sheet of corrugated fiberboard to be folded into the section shown in FIG. 8. The box beam is held into its configuration by tabs positioned to fold into a locking relationship with openings (not shown) in box beam 411, in the manner in which the triangular beam of support piece 312 of FIGS. 3–5. This, too, is in accordance with the particular description of the first embodiment with reference to FIG. 3A.

Other embodiments of support pieces are as shown in FIG. 8. A two-piece dunnage device 500 comprises a cushioning piece 510 and a supporting piece 512. The supporting piece 512 is scored and folded into a box beam 511 in accordance with the teachings of FIG. 3A. Box beam 511 is held into its structure by tabs 546 through holes (not shown), again in accordance with the teaching of FIGS. 3–5 inclusive. Box beam 511 extends into a flap 515 having an outboard flap 542 which may be positioned over one of the walls, here, side wall 560 of the container 352.

Yet another embodiment, shown without a cushioning piece provides for a triangular support piece 612 held into such structure by tabs in accordance with the teachings in connection with FIG. 3A describing the first embodiment. A flap 615 is used to position and space the support piece 612 from the side wall 360 of container 352.

Figure 13:
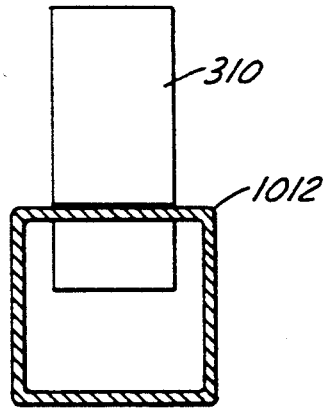
Figure 14:
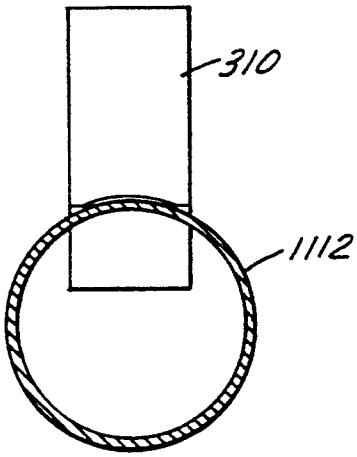

Referring now to FIGS. 9–12, it is to be appreciated that a number of materials may be used for the support pieces 312, 712, 812 and 912, which are respectively made of corrugated fiberboard, chip board, corrugated plastic, and solid plastic. In each instance, the cushioning piece 310 is mechanically attached to the support piece 312, 712, 812 or 912. Additionally, as can be seen in FIGS. 13 and 14, a support piece 1012 and 1112 may be respectively made of PVC tubing and a square extruded shape. According to this teaching any other extruded shape may be used. It should also be appreciated that while particular shapes of the cushioning piece have been shown, the cushioning elements may have end faces that are of a configuration depending on the cushioning needs of the articles to be shipped in the shipping container 352.

It should be understood that a dunnage device in accordance with the present invention has been described in detail but may be subjected to modifications and other embodiments incorporating the inventive features. Accordingly, it is intended that the foregoing disclosure is to be considered as illustrating the principles of the present invention as an example of those features and not as a delimiting description, which is the purpose of the claims that follow:

We claim:

1. A two-piece dunnage device comprising:

a cushioning piece having an extended web wall provided with two opposing sides, a plurality of spaced apart cushioning elements extending from one of said sides of said web wall, and at least one locking tab extending from the other of said opposing sides of said web wall; and a supporting piece having at least one opening for receiving said locking tab of said web wall to hold said cushioning piece in locked engagement with said supporting piece.

2. The two-piece dunnage device of claim 1, wherein said supporting piece includes a beam structure.

3. The two-piece dunnage device of claim 2, wherein said beam structure is hollow.

4. The two-piece dunnage device of claim 2, wherein said supporting piece is a corrugated fiberboard sheet and said cushioning piece is made from a plastic foam material.

5. The two-piece dunnage device of claim 4, wherein said corrugated fiberboard supporting piece is formed as a beam by being folded into a cross-sectional shape having a width and depth.

6. The two-piece dunnage device of claim 5, wherein said corrugated fiberboard sheet has corrugated tabs extending therefrom and said corrugated sheet has holes for receiving said tabs, said beam structure being held into its formation by said tabs being inserted into said tab openings and being locked therein.

7. The two-piece dunnage device of claim 6, wherein said beam is formed in cross-section as a triangle.

8. A combination of a shipping container and a two-piece dunnage device, said combination comprising:

said two-piece dunnage device including a foam plastic cushioning piece and a folded supporting piece, said supporting piece being formed as a beam having a width and depth and said cushioning piece having a plurality of spaced cushioning elements extending away from said supporting piece, said cushioning piece being mechanically attached to said supporting piece without adhesives or bonding agents, said supporting piece having a pair of end flaps; and said shipping container having end walls and side walls and a floor and said shipping container including a cover, said end flaps of said supporting piece being attachable to and supported by said end walls.

* * * * *